United States Patent [19]

Breeden

[11] Patent Number: 4,657,437

[45] Date of Patent: Apr. 14, 1987

[54] MOBILE, OFFSHORE, SELF-ELEVATING (JACKUP) SUPPORT SYSTEM WITH ADJUSTABLE LEG INCLINATION AND FIXATION

[76] Inventor: John O. Breeden, 107 Ballentine St., Bay St. Louis, Miss. 39520

[21] Appl. No.: 690,722

[22] Filed: Jan. 11, 1985

[51] Int. Cl.[4] ..... E02B 17/08

[52] U.S. Cl. ..... 405/198; 405/196

[58] Field of Search ..... 405/196, 197, 198, 199, 405/200; 254/95, 98

[56] References Cited

U.S. PATENT DOCUMENTS

| | | | |
|---|---|---|---|
| 3,171,259 | 3/1965 | Roussel | 405/199 |
| 3,367,119 | 2/1968 | Rybicki | 405/196 |
| 3,402,557 | 9/1968 | Steele | 405/198 |
| 3,750,210 | 8/1973 | Barnard et al. | 405/199 X |
| 4,437,792 | 3/1984 | Durand | 405/198 |

FOREIGN PATENT DOCUMENTS

| | | | |
|---|---|---|---|
| 2383119 | 11/1978 | France | 405/196 |

*Primary Examiner*—David H. Corbin

*Attorney, Agent, or Firm*—Pravel, Gambrell, Hewitt & Kimball

[57] ABSTRACT

A leg support system for mobile, marine, jackup units of the type having a floating barge having telescoping legs upon which the barge can self-elevate. The jack towers are movably positioned on the vessel deck and are adapted to tilt into variable angles so that the legs can be spread wider apart when they rest on the bottom of the ocean. The bottom of the legs are fitted with a foot (can). With the cans further apart and the legs inclined to preselected variable angles, the stability against overturning is increased, and leg bending moments are reduced during all conditions; including storms, transit, drilling and "punch through." Because of this adjustable leg inclination feature, the tilted legs inboard chords can be connected to adjacent chords at the top of the legs during transit conditions, thereby reducing the leg stresses. The jack tower guidance system consists of upper and lower guide rollers which contact the specially shaped chord sections and support the legs as they are extended or retracted by the elevating jacks. Each jack tower positioning system consists of a pair of hinges on the sides of the respective legs, facing the center of the jackup barge unit, and a yoke tower is located on the side of each leg away from the center of the unit. The elevating mechanism in the yoke tower can selectively raise or lower the outboard edge of the jack tower, which in turn moves the leg's can in or out from the center of the unit. The hinges provide fixation in all directions except translation normal to the axis of the hinges. This system with the rigid frame provides fixation between the jack tower and the hull of the unit.

22 Claims, 18 Drawing Figures

MOBILE, OFFSHORE, SELF-ELEVATING (JACKUP) SUPPORT SYSTEM WITH ADJUSTABLE LEG INCLINATION AND FIXATION

BACKGROUND OF THE INVENTION

1. Technical Field

The present invention relates to self-elevating marine vessels known as "jack-up barges," "jack-up rigs or platforms" or "-up units," as typically used in the offshore oil industry, usually as mobile oil well drilling rigs. More particularly, the present invention relates to a system for inclining the movable, telescoping independent legs of a jack-up unit with respect to the hull portion in order to improve stability in bad weather conditions, for example. The system spreads the feet (cans) of the legs and at the same time maintains fixation between all chords of the legs and the unit's platform or hull. Spreading the feet reduces the leg load due to overturning moments, caused by winds, waves, currents, dynamic motions, and "punch thru." The fixation system lessens the introduction of leg chord stresses due to horizontal guide forces for absorbing leg moments by transmitting the chords' axial stresses directly into the jack tower.

2. General Background

The terms "jack-up rig," "jack-up barge" and "jack-up unit" relate to mobile marine vessels having three or more independent legs, each movably affixed to a floating or floatable barge-like hull or platform. The legs can change elevation with respect to the hull so that the legs can extend to the sea bottom and form a structural base for the hull. The barge-like hull can then be elevated using powered jacks contained within structural jack towers mounted on the hull. The jacking mechanism is used to effect changes in vertical elevation between the hull or platform and the legs. Many jack-up units use a rack and pinion-type jacking system to elevate the hull with respect to the legs. An early article entitled "Platform Jacking Mechanisms," showing a jack-up unit with an opposed pinion, rack and pinion-type contin'-'o"s jacking mechanism was published in *Lapic Industrial Opportunities* by Kenneth Mason Publications, Ltd., 107 Victoria Street, London 8WI.UK., Issue No. 37, October 1961. Various patents also describe rack and pinion-type jacking mechanisms for jack-up units. Such a system is shown, for example, in FIGS. 6 and 11 of R. G. LeToureau's U.S. Pat. No. 3,183,676 entitled "Mobile Sea Platform," issued on May 18, 1965. The Wilke et al. patent entitled "Leg Supported Offshore Structure with Jacking Apparatus" shows another such rack and pinion type jackup barge. That patent was originally issued as U.S. Pat. No. 3,606,251 on Sept. 20, 1971, and then reissued as U.S. Pat. Re. 29,539 on Feb. 14, 1978 and assigned to Armco Steel Corp. U.S. Pat. No. 4,269,545 issued on May 26, 1981 to J. L. Goldman et al. shows a fixation system employing a "rack chock" for rigidly attaching the legs to the hull of a jack-up unit.

In 1964 to 1966, Marathon Le Tourneau built mobile offshore jack-up drilling units with tilting legs. These units which included Zapata Off-Shore Company units named "Chaparral," "Endeavour," "Heron," and "Intrepid," were three chord legs, three legs per unit and had only the inboard chords of each legs attached to the hull by elevating jack and guides. In 1967 and 1972, Marathon Le Tourneau built similar units with tilting legs including Zapata Off-shore Company units named "Explorer" and "Nordic." These units have three legs with four chords per leg. The legs are carried by a structure which is the full depth of the hulls with the elevating jacks being part of the structure and located above the main deck. This supporting structure pivoted about two points which are on the vertical center line of the legs, opposite sides of the leg and half of the hull depth. These support methods were designed to take the leg moments due to storm loadings as a horizontal couple, which creates a higher chord stress. These are shown in the September, 1983 issue of "Ocean Industry" as part of the 1983–84 Directory of Marine Drilling Rigs. (Note for example page 176 of the September 1983 issue of Ocean Industry.) These units did not use a positioning frame (jack tower) to change the inclination of the legs, yet provide rigidity between the legs and the hull and transmit the leg loads directly into the hull. A similar system with inwardly sloping legs is in the Durand, et al. U.S. Pat. No. 4,437,792. The legs of Durand et al. can be interconnected at the center of the platform to form a pyramid for the purpose of eliminating stresses on the legs during towing.

In order to insure adequate foundations for the unit's footing on the sea bottom, additional sea ballast is usually added prior to elevating the unit, so that the total bearing pressure is greater than that expected during the maximum storm conditions, when the unit is elevated. This additional load, called "preload," pushes the legs down into the sea bottom when it is soft. There often exists sand strata in the seabed, which are hard layers that must be penetrated. Penetrating these sand strata layers has frequently caused problems. The procedure can be difficult and damaging to the legs. The damage occurs, for example, when there is rapid settling of one leg only. The unit leans over, placing the legs in bending.

Existing truss-type independent leg jack-up units are three or four chord leg designs. Chords have been fabricated from inter alia, straight or curved plates, pipe sections, or rolled structural members. Chord size and shape determines the wave loadings. Smaller chords are subject to higher secondary bending stresses in the guides for equal bay lengths. The chords slide upon the guiding surfaces in the jack towers or upon the hull. Since it is not possible to provide adequate lubrication with extremely high loads, wear on the rack teeth and/or chord surfaces and guides can be extensive and damaging.

Existing jack-up rigs utilize a fixed jack tower. Such affixed jack towers can be seen, for example, in FIGS. 1B, 9B and 2 of the Goldman et al U.S. Pat. No. 4,269,543, FIG. 1A of the Choate U.S. Pat. No. 4,422,802, FIG. 1 of the Lovie U.S. Pat. No. 3,967,457, and FIGS. 2 and 9 of the Wilke reissue U.S. Pat. No. 29,539. The jack tower structures incorporate the elevating jack and guides.

GENERAL DISCUSSION OF THE PRESENT INVENTION

The present invention solves these prior art problems and shortcomings by providing a marine jackup platform apparatus with an adjustable leg inclination support associated with preferably each leg so that various leg inclination positions can be formed between the vessel platform and each respective leg when the hull is elevated and being supported by the legs. The apparatus includes a platform providing a work area thereon such as, for example, an oil and gas well drilling apparatus. The platform can be a floating hull. In the preferred embodiment, the jack towers are pivotally connected to the platform and powered into various angular positions with respect to the platform deck. At least three support legs are each movably affixed with respect to the platform at varying elevations and inclination so the legs can extend above the platform such as during transit. Powered jacking mechanisms elevate the platform with respect to the legs. An adjustable inclination support assembly associated preferably with the jacking mechanisms forms a structural support between the platform and each respective leg so that the legs can be positioned in varying angles of inclination with respect to the platform or hull. In the preferred embodiment, a structural jack tower includes jacking mechanisms which are associated with each chord of a respective leg of the jack-up unit. The jack towers are movably mounted upon the platform so that each jack tower can be adjustably moved into multiple positions which respectively vary inclination of the leg associated therewith.

With the present invention, the legs slope out from the center so that the legs are not placed in a bending condition for the "punch thru" penetrations experienced. This configuration will essentially eliminate the very high bending stress and damage to the unit's legs.

The present invention provides a small, compact chord section for low wave loads, specially shaped for roller guide surfaces. Rollers are fitted in the jack tower guides so the legs will roll and not slide. In order to reduce the chord stress due to the guide loads while being extended, special bracings are provided between the bracing bays.

The chords may be rolled in a steel mill to acquire the desired special shape. The rack tooth face width is preferably kept as large as possible to reduce gearing loads during elevating. All possible surfaces are curved to maintain a low drag coefficient.

The present invention utilizes a jack tower which is movable with respect to the hull. On the inboard side, it it fixed to the hull by a pair of hinges, and on the outboard side it is elevated by a yoke tower.

While the fixation systems have greatly improved the efficiency of the designs, they are limited by preload capability; high natural periods; transit leg strength; limited "punch thru" capability; and high construction cost.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF THE PREFERRED EMBODIMENT

Figure 1:
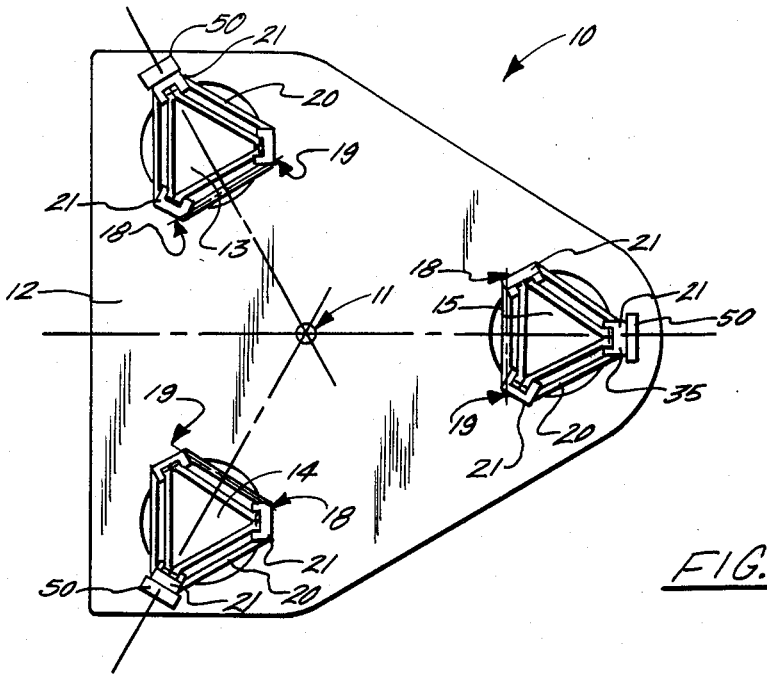
FIG. 1 is a top view of the preferred embodiment of the apparatus of the present invention illustrating the vessel hull and the positioning of the jack towers, hinges and yoke towers and leg portions thereof.
Figure 2:
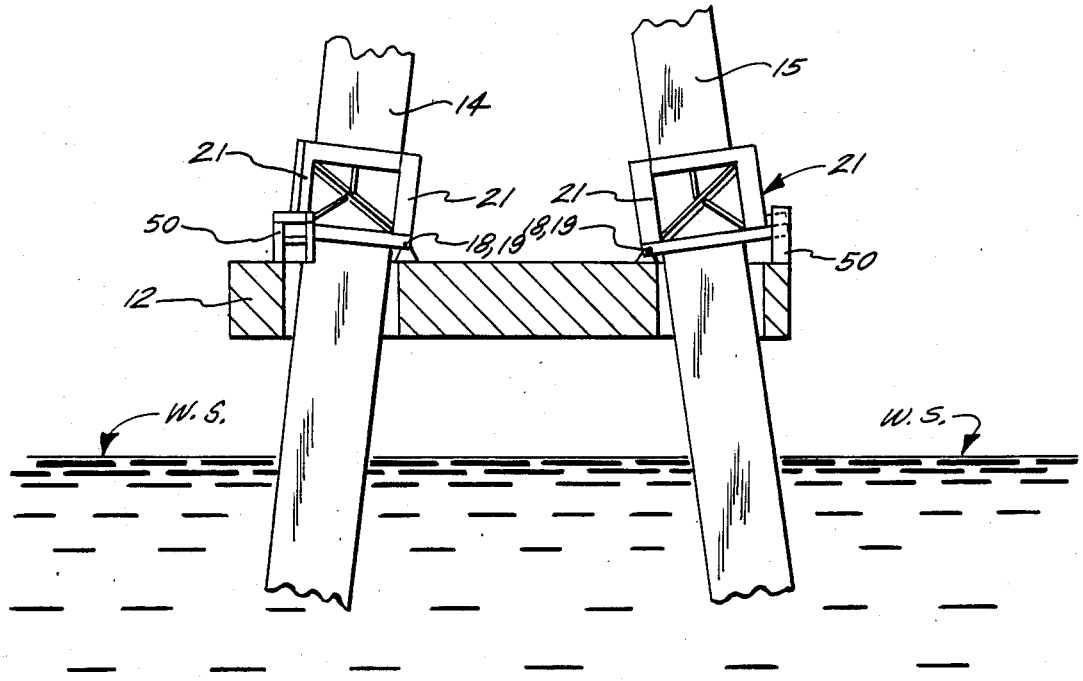
FIG. 2 is a side elevational view of the preferred embodiment of the apparatus of the present invention illustrating the vessel hull and leg portions thereof with the legs shown in an inclined position wiht respect to the hull.

FIGS. 1 and 2 illustrate the preferred embodiment of the apparatus of the present invention designated generally by the numeral 10, with a plan view of platform 12, which can be for example a floating hull, of jack-up unit 10 including three legs 13–15. Each leg 13–15 is connected through a leg tower 20 (also known as a jack tower) to platform 12 by a pair of hinges 18, 19, and a leg yoke tower 50. Hinges 18, 19 are on the inboard side of each respective leg 13–15, and preferably on a line which is normal or at right angles to a line passing through the center of each leg 13–15 and the centroid 11 of the legs 13–15. FIG. 2 shows platform 12 and the inclination of the legs 13–15 as they rotate about the hinges 18, 19. This pivotal movement of the legs 13–15 with respect to the platform 12 projects the legs 13–15 outward below the platform 12 and inward above the platform 12 as illustrated (FIG. 2). The yoke tower 50 supports the outboard corner 21 of leg jack tower 20 in variable selected positions that enable the legs to be inclined with respect to the platform while the platform is supported by the legs. By inclining the legs 13–15 with respect to the platform, the entire jack-up unit 10 can better withstand the forces of wind and wave action upon the legs 13–15 and platform 12 during storms.

Figure 3:
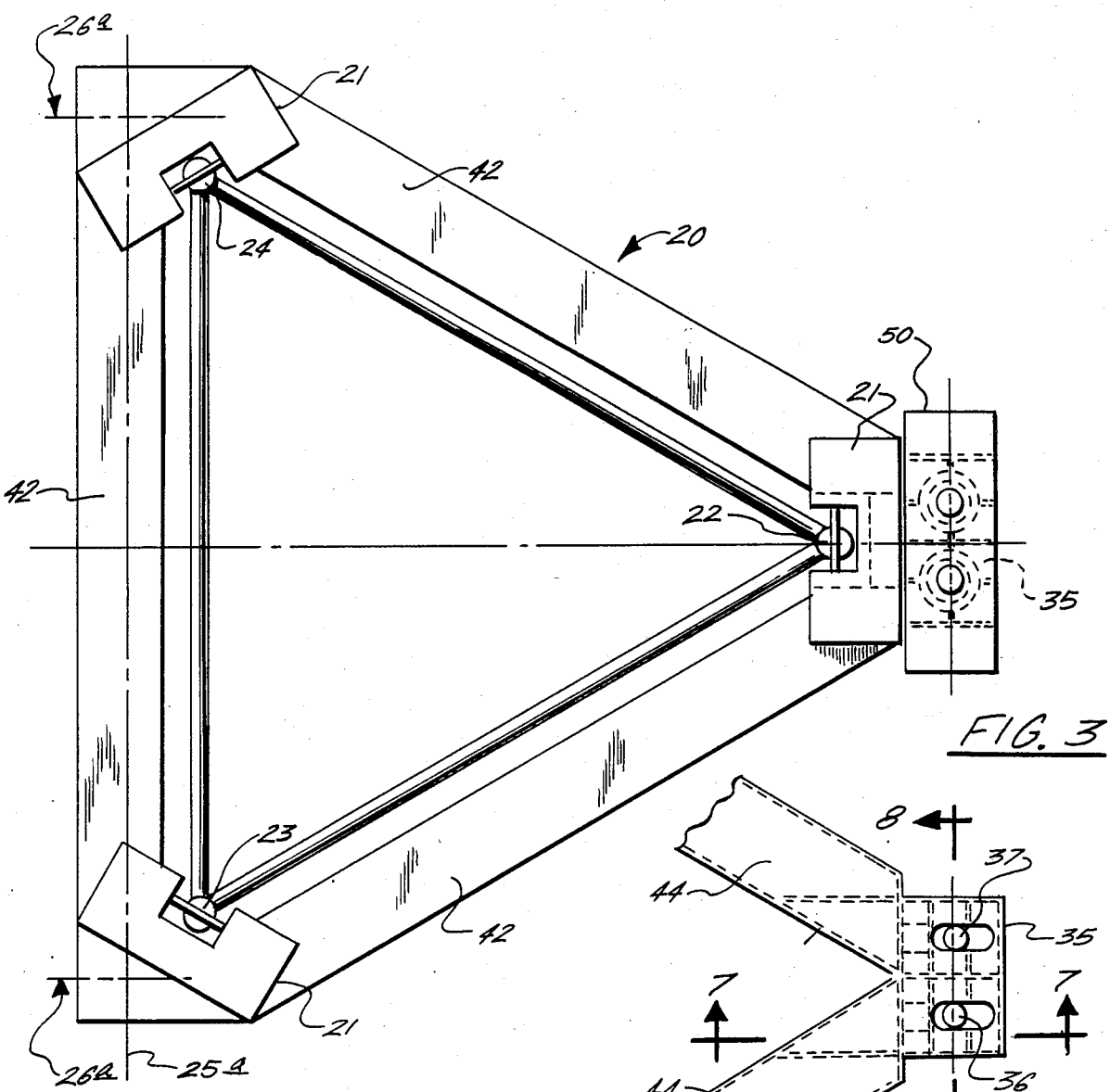
FIG. 3 is a top view of the preferred embodiment of the apparatus of the present invention illustrating a plan view of the jack tower portion thereof.
Figure 4:
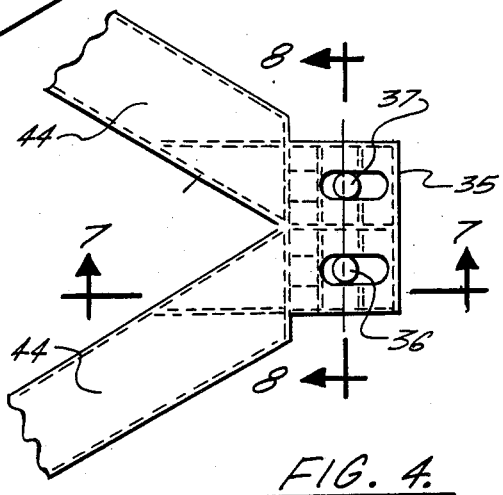
FIG. 4 is a fragmentary view of the preferred embodiment of the apparatus of the present invention illustrating the end of the jack tower which is engaged by the yoke tower and positioning screws.
Figure 5:
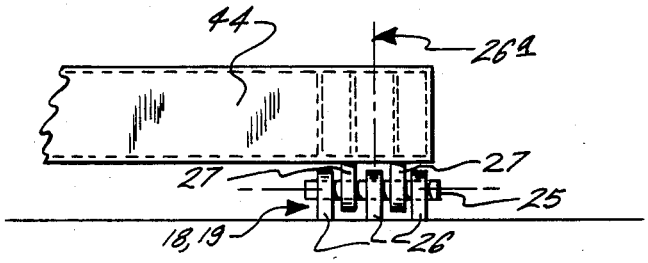
FIG. 5 is a fragmentary view of the hinge portion which forms a connection between the hull and the jack towers.
Figure 6:
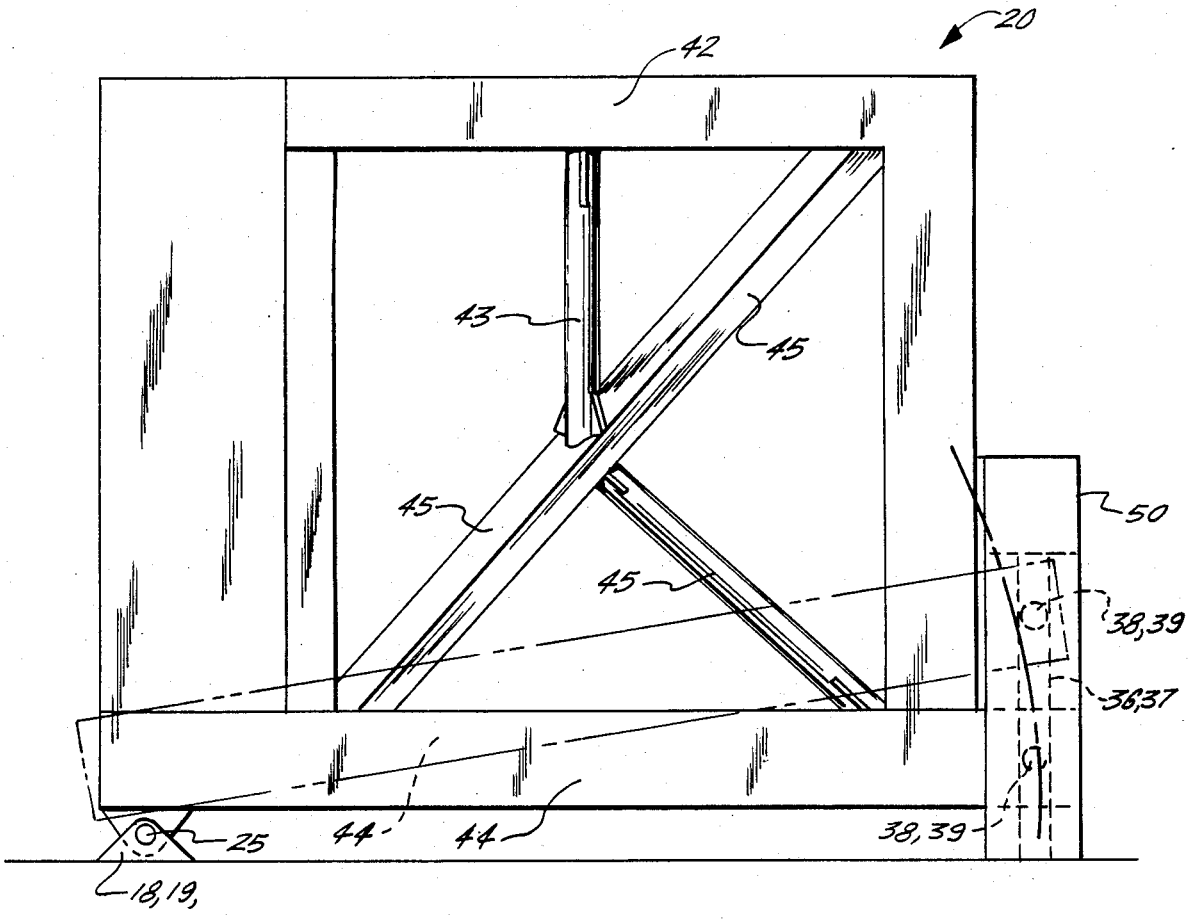
FIG. 6 is a side elevational view of the jack tower portion of the preferred embodiment of the apparatus of the present invention showing the combined jack and fixation units foundation, the jack tower bracings, the yoke tower, and hinge.
Figure 9:
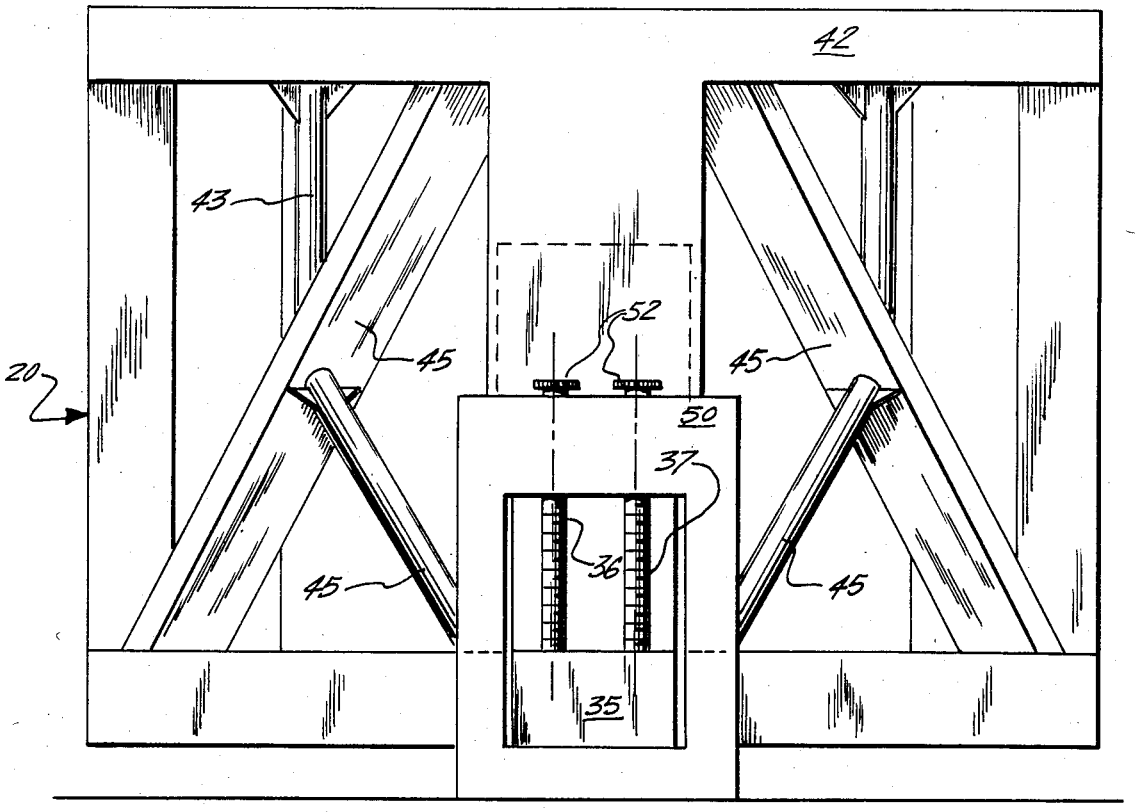
FIG. 9 is a front view of the jack tower, showing the combined jacks and fixation units, the jack tower bracings, and the yoke tower.

The leg jack tower 20 is preferably a rigid frame structure shown by FIG. 3 (plan view), FIG. 6 (side elevation view), and FIG. 9 (front elevation view). At each corner of deck 12 are jack towers 20 which include combined jack and fixation vertical unit foundations 21 (FIG. 10) and a yoke tower 50. Each jack tower 20 is reinforced with upper and lower braces 42 and 44 respectively and by vertical brace 43, and by diagonal braces 45. Jack towers 20 are used to support platform 12 upon legs 13–15. Each jack tower 20 surrounds a respective leg 13–15. The leg chords 22–24 of each leg 13–15 pass within each jack tower 20 and engage the associated combined jack and fixation units 21 (see FIG. 10). Jack towers 20 are connected to platform 12 by hinges 18, 19 as shown in FIGS. 2, 3, 5 and 6. The hinges 18, 19 include pad eyes 26, 27 that rotate on shaft 25 and can have thrust plates to take horizontal forces which are parallel to hinge shaft 25. Two hinges 18, 19 are fitted to each jack tower 20, and the two associated hinge shafts 25 have a common centerline **24*a* and thus rotate about the same point. The jack tower 20 has a yoke tower 50, end foundation 35 at the side opposite hinge centerlines 24*a*, 26*a* as shown in FIGS. 3, 4**.

Figure 7:
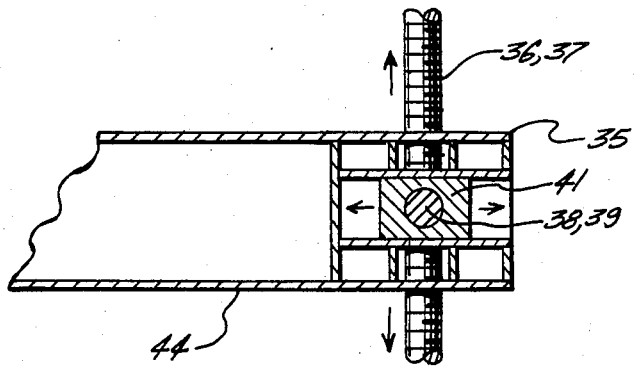
FIG. 7 is a fragmentary view illustrating the yoke end foundation of the jack tower, the sliding shoe, the swivel nut, and the positioning screw portions thereof.
Figure 8:
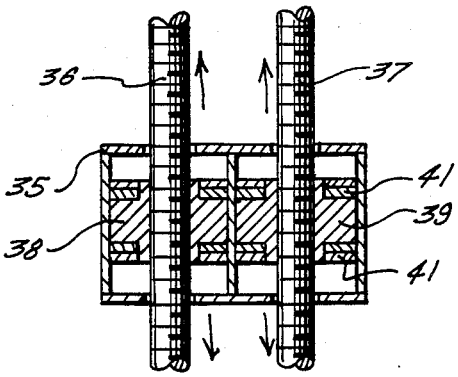
FIG. 8 is a sectional view taken along lines 8—8 of FIG. 4 showing the yoke end foundation, the sliding shoe, the swivel nut and the positioning screws.
Figure 11:
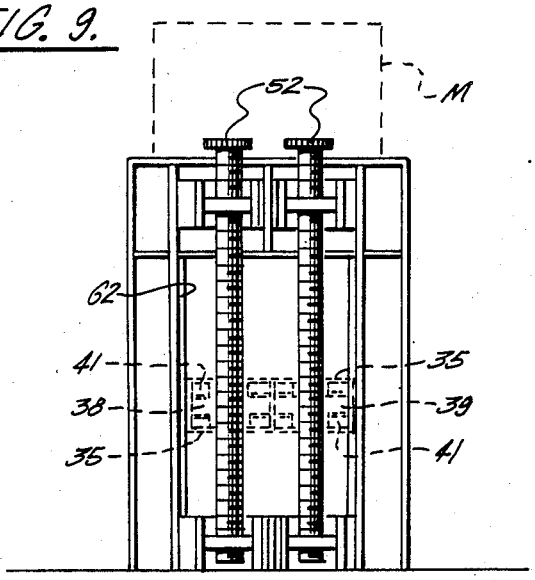
FIG. 11 is a partial view of the jack tower yoke including the thrust assemblies, position screws, swivel nuts, yoke tower, guides plates and hull.

Yoke tower 50 is shown in FIGS. 3, 6, and 9. Each yoke tower 50 is connected to end foundation 35 of jack tower 20 by positioning screws 36, 37, swivel nuts 38, 39, and sliding shoe 41 as illustrated in FIGS. 7 and 8. Slots are provided in end foundation 35 to accommodate screws 36, 37 during pivotal movement of jack tower 20 (FIGS. 4, 6). At end foundation 35, screws 36, 37 are fitted with thrust assemblies which are commercially available to take thrust in both directions. FIG. 11 shows a connection to a rotary drive unit 52 which is used to rotate the screws 36, 37. Rotary drive M is schematically shown in FIGS. 9, 11 and could be pneumatic, hydraulic or electric. This rotation of screws 36, 37 causes swivel nuts 38, 39 to raise or lower the jack tower end foundation 35 which pivots jack tower 20 about hinges 18, 19. End foundation 35 is guided in yoke tower 50 by guide plates 62 to absorb horizontal forces.

Figure 10:
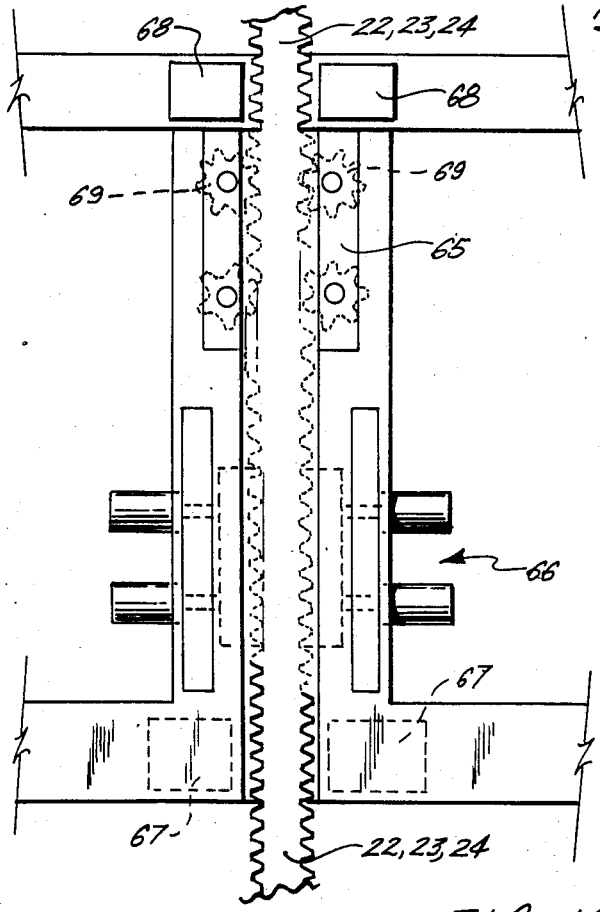
FIG. 10 is a fragmentary elevation view of the jack tower including the elevating jacks, pinion gears, fixation units, the lower guide, and upper guides, as well as the leg chord racks and elevating pinions.

FIG. 10 shows a view of the combined elevating jack 65 and fixation unit 66 looking from inside the leg 13–15 outward. The leg 13–15 chords 22–24, pass through the lower guide 67, fixation unit 66, elevating jacks 65, and upper guide 68. The elevating jacks are connected to the leg chord racks with elevating pinions 69.

Figure 14:
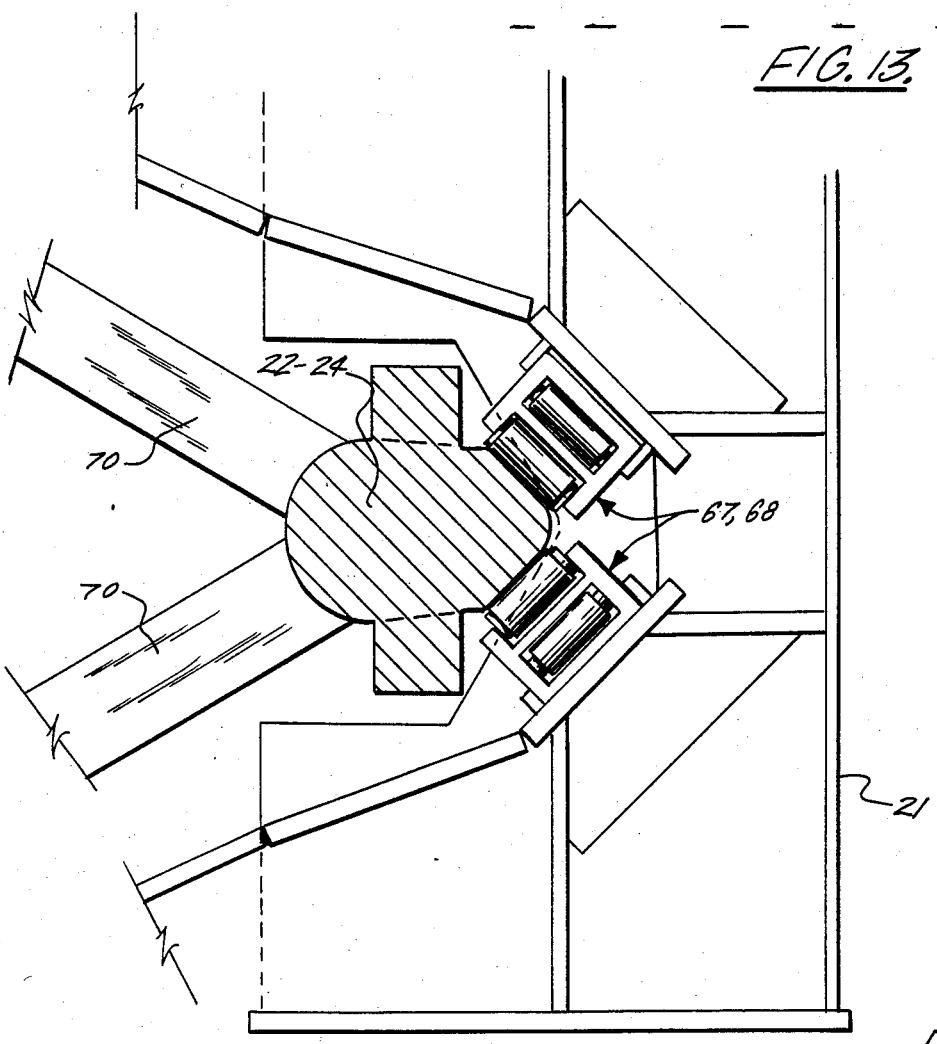
FIG. 14 is a partial plan view of the preferred embodiment of the apparatus of the present invention illustrating the leg chords, the leg chord racks, leg bracings, guide rollers, and combined jacks and fixation unit foundation.

FIG. 14 shows the specially shaped leg chords 22–24, and the guide rollers 67, 68 used at the upper 68 and lower 67 guides in the combined yoke and fixation unit foundation. Guide rollers 67–68 can be commercially available Hillman type rollers or equal.

Figure 12:
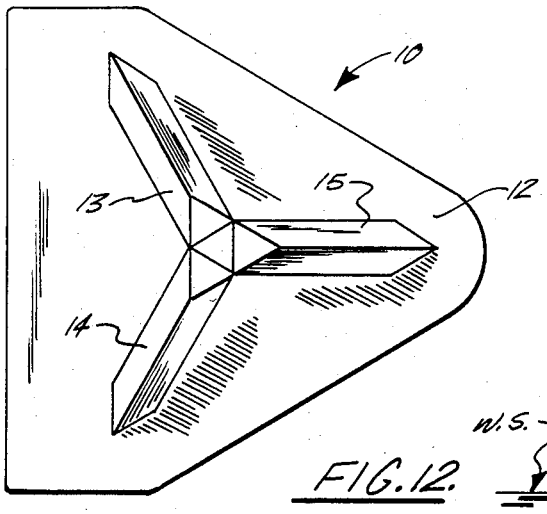
FIG. 12 is a plan view showing the inclined legs adjacent chords as connected at the top during transit operation.
Figure 13:
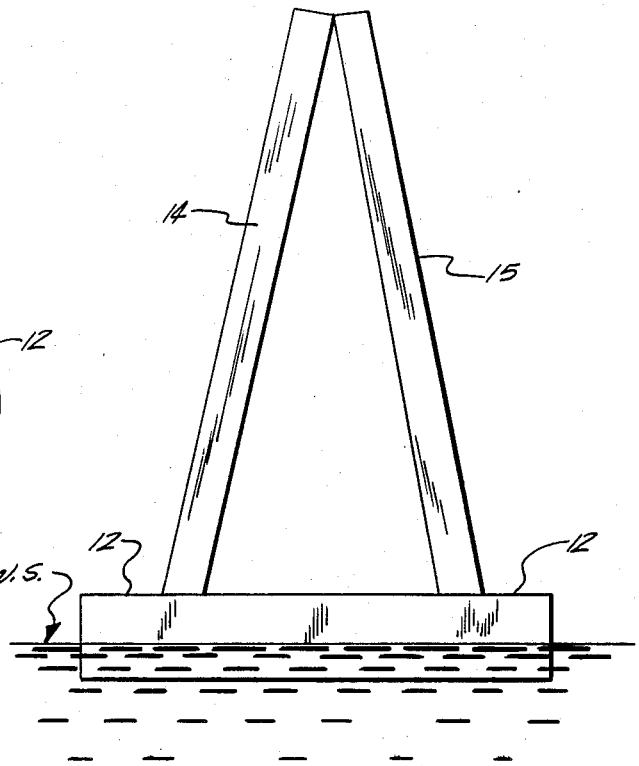
FIG. 13 is an elevational view of the legs, showing the chords as connected at the top for transit operation.

FIG. 12 shows the legs 13–15 sloping inwardly toward each other above platform 12 and connected at the top end portions of the legs 13–15.

Figure 17:
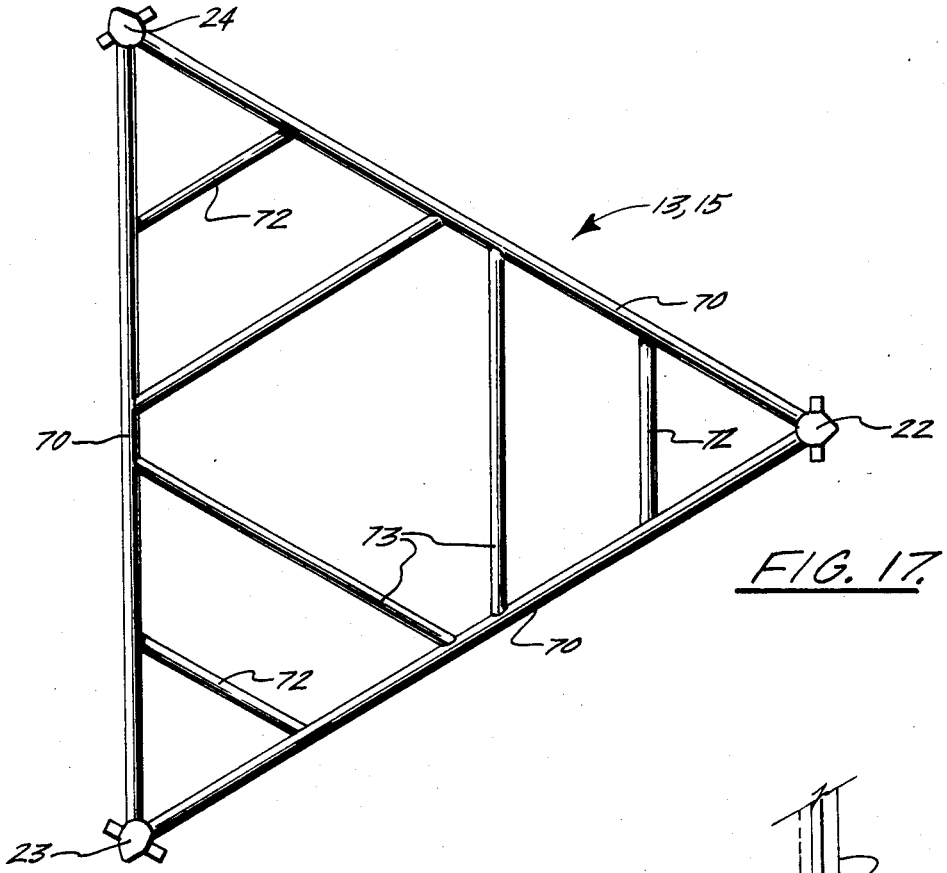
FIGS. 17 and 18 are plan and elevational views respectively of the legs, showing the chords and bracing.
Figure 18:
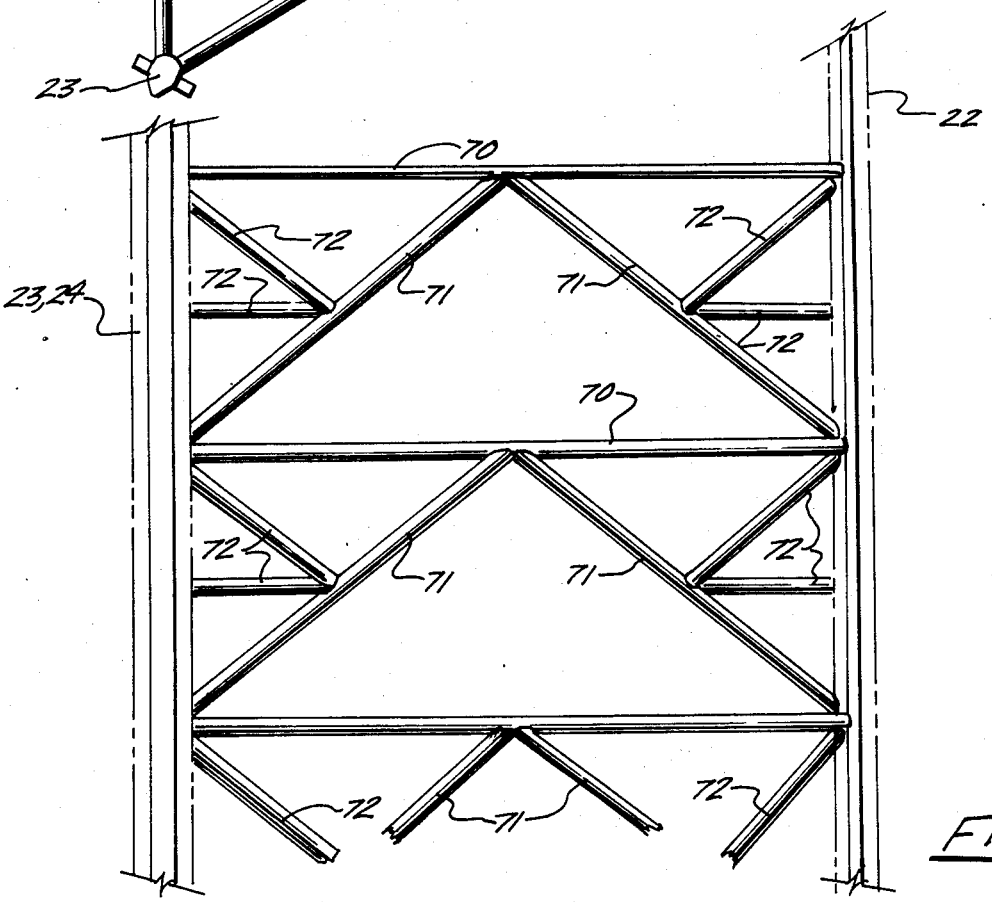

FIGS. 17 and 18 show the special bracings 72 applied between bays of legs 13–15 to reduce the support length of the chords. The roller guide reactions on the leg chords 22–24 are taken by the horizontal braces 70 and diagonal brace 71, and the special braces 72.

Figure 15:
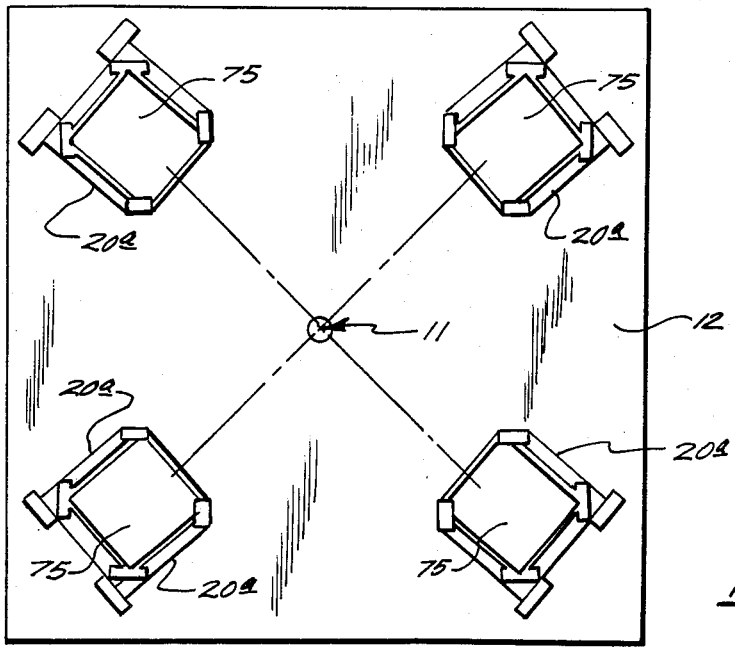
FIG. 15 is a plan view of a jack-up unit hull showing four legs, their arrangement with respect to the platform and the location of the leg tower, hinges, and yoke towers.
Figure 16:
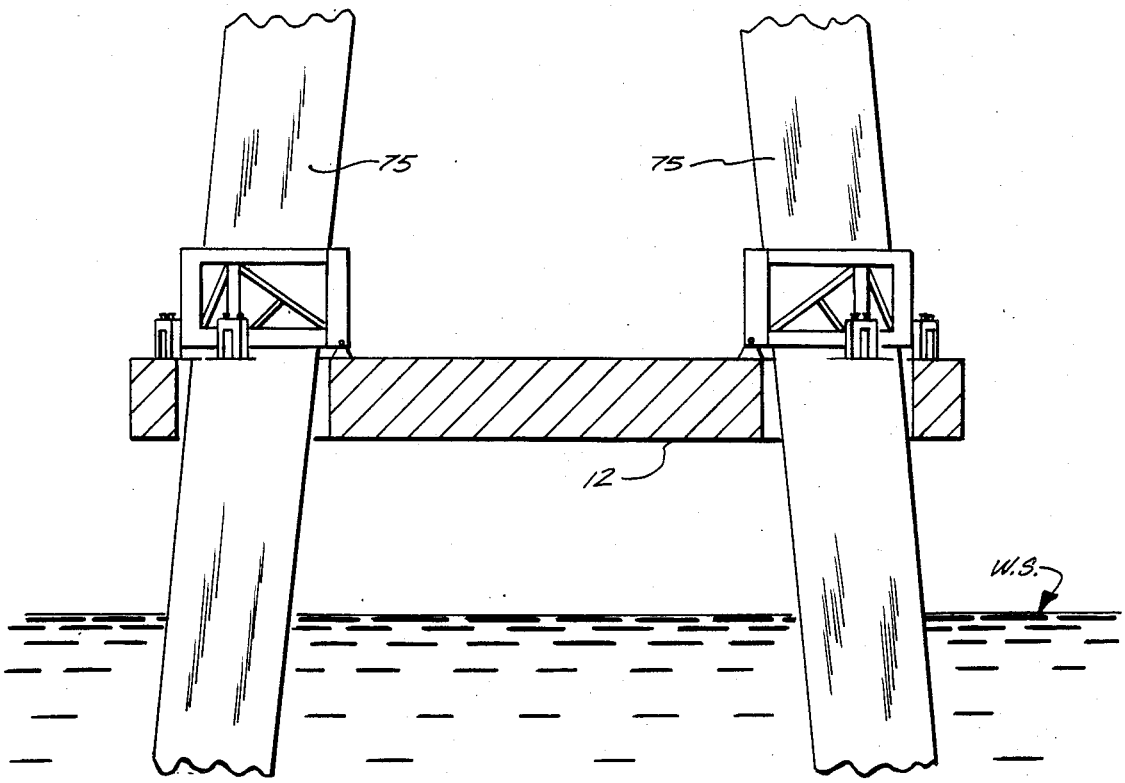
FIG. 16 is an elevational view of the four leg jack-up unit of FIG. 15.

FIGS. 15 and 16 illustrates a rectangular jackup unit with four square legs, but otherwise are similar in construction to the triangular unit 10 with three triangular legs 13–15 shown in FIGS. 1–2. Square jack towers 20a surround each square leg 75 Within the teaching of this invention more than four legs could be provided such as for example, a jackup unit with six or eight. Instead of the yoke tower with positioning screws, etc., the jack tower could be positioned using another elevating jack and fixation unit connected to the platform or hull with links so that it moves on the same arc as the jack tower. The elevating jacks and fixation unit would operate on a section of rack attached to the jack tower.

While the method is described above, many other variations will occur to those skilled in the art. It is intended that all such variations which fall within the scope of the appended claims be embraced thereby.

What is claimed is:

1. A marine jack-up platform apparatus with adjustable inclination leg supports comprising:

a. a platform providing a deck structure with an upper work area thereon;

b. at least three support legs, each movably affixed to the vessel platform at varying elevations so that extension of the legs can elevate the vessel platform above a water surface;

c. powered jacking means pivotally mounted on the deck structure in the work area for elevating the vessel platform with respect to the legs;

d. adjustable inclination support means including a pivotal connection of the jacking means with the deck structure for forming a structural support between the vessel platform and at least one of the legs at variable angles of the leg inclination when the platform is being supported by the legs;

e. including extensible means spaced laterally from the pivot and having a longitudinal axis generally parallel to the leg for elevating one lower edge portion of the jacking means generally opposite the pivotal connection so that an axial load path transfers load between the leg and the platform.

2. The marine jack-up platform apparatus of claim 1, wherein a substantially vertical load path transfers load between the leg and the platform.

3. The marine jack-up platform apparatus of claim 1, wherein all of the legs can be adjustably inclined with respect to the platform so that the legs can be set in an inclined position when the platform is structurally supported by the legs.

4. The marine jack-up platform apparatus of claim 1, wherein the jacking means includes a structural jack tower associated with each leg, and movably mounted upon the platform, so that the jack tower can be adjustably moved into multiple positions which respectively vary inclination of the leg associated therewith.

5. The marine jack-up platform apparatus of claim 4, wherein the jack towers are pivotally connected to the vessel platform.

6. The marine jack-up platform apparatus of claim 3, wherein the adjustable inclination support means includes powered tilting means for rotating each jack tower about its pivotal connection to the vessel platform.

7. The marine jack-up platform apparatus of claim 4, wherein the powered tilting means comprises one or more extensible elevating means positioned between the jack tower and vessel platform generally opposite the pivotal connection of the jack tower to the vessel platform.

8. The marine jack-up platform apparatus of claim 7, wherein the elevating means comprises in part one or more rotatable screws threadably connected to the jack tower so that rotation of the screw can rotate the jack tower about its pivotal connection to the vessel platform.

9. The marine jack-up platform apparatus of claim 4 wherein each leg is formed of a truss of chord sections including at least three longitudinal chords interconnected with multiple braces, at least two of the longitudinal chords being inboard chords, and the adjustable inclination support means includes hinged connection means on the inboard chord of each leg for allowing each leg to angle with respect to the vessel platform.

10. The marine jack-up platform apparatus of claim 9 wherein each leg carries an elongated longitudinal rack of teeth and the powred jacking means includes one or more pinion gears which engage the track.

11. The marine jack-up platform apparatus of claim 1 wherein the platform is a floatable hull which supports the legs when the hull floats and can be supported by the legs when the legs are extended below the hull to engage the seabed.

12. The marine jack-up platform apparatus of claim 4 wherein the jack tower is a rigid frame carrying elevating jacks.

13. The marine jack-up platform apparatus of claim 11 wherein the jack-up tower includes fixation means for locking the legs with respect to the platform.

14. The marine jack-up platform apparatus of claim 7 wherein the powered tilting means comprises:

i. one or more elevating screws;

ii. power means for rotating the screws;

iii. load transfer means for forming a connection between the elevating screws and the jack tower.

15. The marine jack-up platform apparatus of claim 9 wherein each leg is formed of a truss of chord sections defining a generally triangular cross section and the jack tower is mounted upon a pair of hinges.

16. The marine jack-up platform apparatus of claim 9 wherein each leg is formed of a truss of chord sections including three longitudinally standing generally parallel chords and multiple interconnecting horizontal and diagonal chords defining bracing between the longitudinal leg chords.

17. The marine jack-up platform apparatus of claim 16 wherein one of the longitudinal leg chords provides a pair of outwardly facing flat roller guide surfaces which define load bearing surfaces for transferring load between the longitudinal leg chord and the jack tower, and the jack tower includes multiple guide rollers which are positioned to bear against the roller guide surfaces.

18. The marine jack-up platform apparatus of claim 1 wherein the legs can be adjusted inwardly or outwardly while the legs are maintained in any vertical position with respect to the barge between the end portions of the leg.

19. The marine jack-up platform apparatus of claim 1 wherein the legs can be raised or lowered while they are in any position of inclination with respect to the platform.

20. The marine jack-up platform apparatus of claim 1 wherein the legs can be maintained in an inclined position when the legs are extended to make contact with the seabed such as during a "punch through" condition.

21. The marine jack-up platform apparatus of claim 1 wherein the legs can be inclined and elevated to a position which enables the tops of the legs to be connected together such as during transit.

22. The marine jack-up platform apparatus of claim 1 wherein the inclination of one of the legs can be changed during elevation of the platform upon the legs.

* * * * *